US005509832A

United States Patent [19]

Roos

[11] Patent Number: 5,509,832

[45] Date of Patent: Apr. 23, 1996

[54] MARINE JET DRIVE

[76] Inventor: Paul W. Roos, 2033-F W. McNab Rd., Pompano Beach, Fla. 33069

[21] Appl. No.: 443,728

[22] Filed: May 18, 1995

Related U.S. Application Data

[63] Continuation-in-part of Ser. No. 699,336, May 13, 1991, Pat. No. 5,421,753, and a continuation-in-part of Ser. No. 338,651, Nov. 14, 1994.

[51] Int. Cl.[6] ..... B63H 11/103

[52] U.S. Cl. ..... 440/47; 440/46; 440/38

[58] Field of Search ..... 440/38, 39, 46, 440/47; 244/53 B; 60/221, 222

[56] References Cited

U.S. PATENT DOCUMENTS

| | | | |
|---|---|---|---|
| 3,040,696 | 6/1962 | Dahle | 440/46 |
| 3,147,733 | 9/1964 | Engel | 440/46 |
| 3,306,046 | 2/1967 | Trapp | 440/46 |
| 3,387,583 | 6/1968 | Kuether | 440/46 |
| 3,405,526 | 10/1968 | Aschauer | 440/47 |
| 3,531,214 | 12/1968 | Abramson | 440/47 |
| 3,613,630 | 10/1971 | Jacuzzi | 440/39 |
| 3,757,728 | 9/1973 | Rhoda | 60/221 |
| 3,805,731 | 4/1974 | Furst et al. | 440/47 |
| 3,824,946 | 7/1974 | Macardy et al. | 115/12 |
| 3,827,390 | 8/1974 | DeVault et al. | 115/12 |
| 3,868,833 | 3/1975 | Noe et al. | 440/38 |
| 3,935,833 | 2/1976 | Onal | 440/41 |
| 3,943,876 | 3/1976 | Kiekhaefer | 440/89 |
| 3,981,262 | 9/1976 | DeVault et al. | 60/221 |
| 3,982,494 | 9/1976 | Posti | 440/43 |
| 3,993,015 | 11/1976 | Klepacz et al. | 440/41 |
| 4,176,616 | 12/1979 | Robins | 440/47 |
| 4,538,997 | 9/1985 | Haglund | 440/41 |
| 4,552,537 | 11/1985 | Haynes | 440/47 |
| 4,954,108 | 9/1990 | Govan | 440/73 |

FOREIGN PATENT DOCUMENTS

| | | | |
|---|---|---|---|
| 1190735 | 5/1970 | United Kingdom | 440/41 |

*Primary Examiner*—Edwin L. Swinehart
*Attorney, Agent, or Firm*—Weintraub, DuRoss & Brady

[57] ABSTRACT

A jet drive for propelling a vessel has a rotatable impeller coupled to an engine. An impeller housing surrounds the impeller. A diffuser housing and a nozzle housing are attached to the impeller housing, which is supported by a transom. An intake duct is disposed in front of the impeller housing. The intake duct has an intake opening, the perimeter of which is defined by a forward edge portion substantially flush and a rear edge portion raised relative to the remainder of the edge, which is substantially parallel to the perimeter to the forward edge. A sloped surface connects the raised rear edge and the lowest point of the transom. The intake duct has a forward facing separator baffle depending from and substantially parallel to the wall and disposed interiorly thereof. The space defined between the separator baffle and the wall is in fluid communication through at least one discharge duct to either one of the transom and bottom.

15 Claims, 5 Drawing Sheets

MARINE JET DRIVE

CROSS-REFERENCE TO RELATED APPLICATIONS

This application is a continuation-in-part of copending U.S. patent application Ser. No. 07/699,336, filed on May 13, 1991, now U.S. Pat. No. 5,421,753, and is a continuation-in-part of copending U.S. patent application Ser. No. 08/338,651, filed Nov. 14, 1994, the disclosures of which are hereby incorporated by reference.

BACKGROUND OF THE INVENTION

1. Field of the Invention

This invention relates to an engine driven marine vehicle. More specifically, the present invention relates to the water intake for such vehicles. Even more particularly, the present invention relates to a water intake which prevents aerated water and debris from accessing the jet pump.

2. Prior Art

Marine jet drives which propel vessels on water jet propulsion have long been known and used due to certain advantages over the traditional propeller disposed externally of a marine vehicle. Jet propulsion systems are especially attractive under circumstances where a conventional ship's propeller would be exposed to damage by contact with underwater objects. These systems are also attractive because they do not produce appendage drag and do not expose swimmers and animals to risk of injury by the rotating blades of an external propeller. In a typical jet propulsion system, an engine driven impeller, rotating inside an impeller housing, pumps water from below the vessel through an intake duct, then pressurizes and expels the water horizontally behind the vessel through a diffuser housing and a nozzle. A typical example of such a conventional marine jet drive is seen in Oual, U.S. Pat. No. 3,935,833, which shows a pump positioned near the bottom and transom of a marine vessel and which may be driven vertically or horizontally.

The known jet drives, such as that shown in the prior art, have certain drawbacks compared with the conventional external propeller propulsion system. A major drawback is caused by the tendency of the jet intake to become less efficient with the increase in speed due to its fixed shape. More water than is needed by the pump tries to enter the intake as the vessel speed increases, causing added drag. A further drawback is intake water aeration at higher speeds due to the dynamics of air and water at the vessel bottom boundary layer, reducing jet efficiency. Further, there is the tendency of waterborne debris to be caught in the water intake duct causing a reduction in efficiency, sometimes to the point of immobilizing the vessel. Clearing the intake duct is a time consuming process requiring the vessel to be stopped. While conventional jet drives have grid cleaning devices, these devices are not effective, and give a false sense of security. In no case can these cleaning systems free the impeller from debris.

Attempts have been made to address some of these problems. For example, Klepacz et alia, U.S. Pat. No. 3,993,015 shows a elevated water intake trailing edge designed for easier manufacturing. Yet, this edge design does not improve jet efficiency at higher speeds.

Thus, the present invention seeks to provide a marine jet drive propulsion system that overcomes the disadvantages of the known jet drives.

SUMMARY OF THE INVENTION

The present invention provides a specific water intake shape which overcomes the drop in efficiency with increased speed by controlling the water inflow. According to the present invention, the trailing edge of the water intake duct opening is in a raised position. The vessel bottom has a angled surface from the trailing edge to the lowest point of the vessel transom. The raised trailing edge produces a diminishing apparent intake opening as the vessel moves faster in a forward direction. The reduction in apparent opening compensates for the increased water velocity and produces a constant water flow to the pump as the speed increases. The efficiency remains substantially constant. Additionally, the angled surface produces added lift to the vessel. The real intake opening is not diminished, so that at low speed water flow into the intake is unchanged.

The present invention also enables separation of aerated water from non-aerated water through a flow separator disposed inside the intake duct. The intake duct has a separator baffle disposed just below the upper wall of the intake duct. Aerated water flows through a second or discharge duct, away from the impeller, and discharges the aerated water through either the transom or the bottom of the vessel. A check valve or the like may be placed in this duct to prevent aeration of the intake water at low speed, when the intake duct pressure may be below atmospheric.

The present invention also includes means for preventing clogging from debris. The means generally comprises: (a) a plurality of tapered grid bars; and (b) an intake debris removal system using pressurized fluid ejection from apertures provided in the grid bars. The grid bars are rearwardly tapered, providing increased clearance toward the rear edge and thus preventing debris from becoming jammed therebetween.

To promote the rejection of large debris such as weed clusters and plastic bags, the grid bars are preferably staggered in the vertical plane.

The intake debris removal system includes through holes found in the bottom of hollow grid bars. The pressured fluid may be compressed gas, such as air or water from the pressure side of the jet pump, or from an independent source. The fluid displaces large debris from direct contact with the grid bar and provides lubrication to promote the release of the large debris from the grid bars.

Means for cutting long stranded debris is placed just forward of the impeller to prevent debris from wrapping around the impeller hub and to thus prevent debris from impairing water flow and causing loss of efficiency.

For a more complete understanding of the present invention, reference is made to the following detached description and accompanying drawings. In the drawings, like reference characters refer to like parts throughout the several views, in which:

DETAILED DESCRIPTION OF THE PREFERRED EMBODIMENTS

Figure 1:
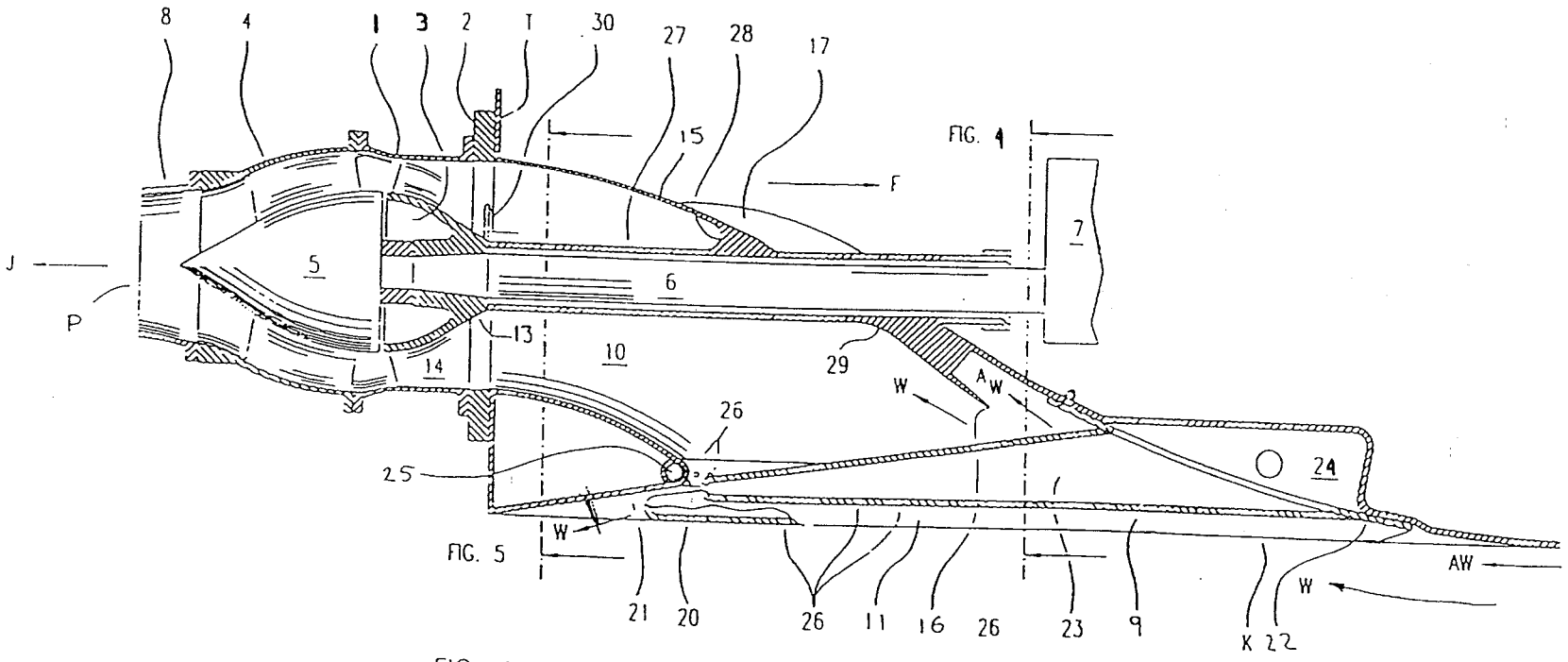
FIG. 1 is a partial cross-sectional side view of the present system taken over the shaft centerline and showing the interior construction including the raised intake trailing edge arrangement; the aerated water removal duct; the tapered bar intake grid with plenum; and the debris cutting device.

In accordance with the present invention and as shown in the drawings, and in particular FIG. 1, there is provided a marine jet drive, generally denoted at J, located generally at the transom T of a vessel V and above the keel surface K. The direction of the jet stream J is rearward, to promote forward movement of the vessel in the direction of the arrow F. The jet drive J has an impeller housing 1, attached to an intake flange 2, which in turn is attached to transom T by any suitable means. A rotatable impeller 3 is disposed within the impeller housing 1. The axis of rotation of the impeller 3 is aligned generally with the keel surface K.

A diffuser housing 4 is connected to the impeller housing 1 and defines a water outlet port P.

An inner housing 5 is disposed inside the diffuser housing 4. A drive shaft 6 rotatably connects the impeller 3 with the engine 7. A nozzle housing 8, forming a rearward facing nozzle, is attached to the diffuser housing 5. A water intake duct 10 attached to the vessel is placed ahead of the impeller housing 1, as shown, and transmits the generated thrust forces to the vessel. An intake grid 11 is disposed within the intake duct 10.

Figure 2:
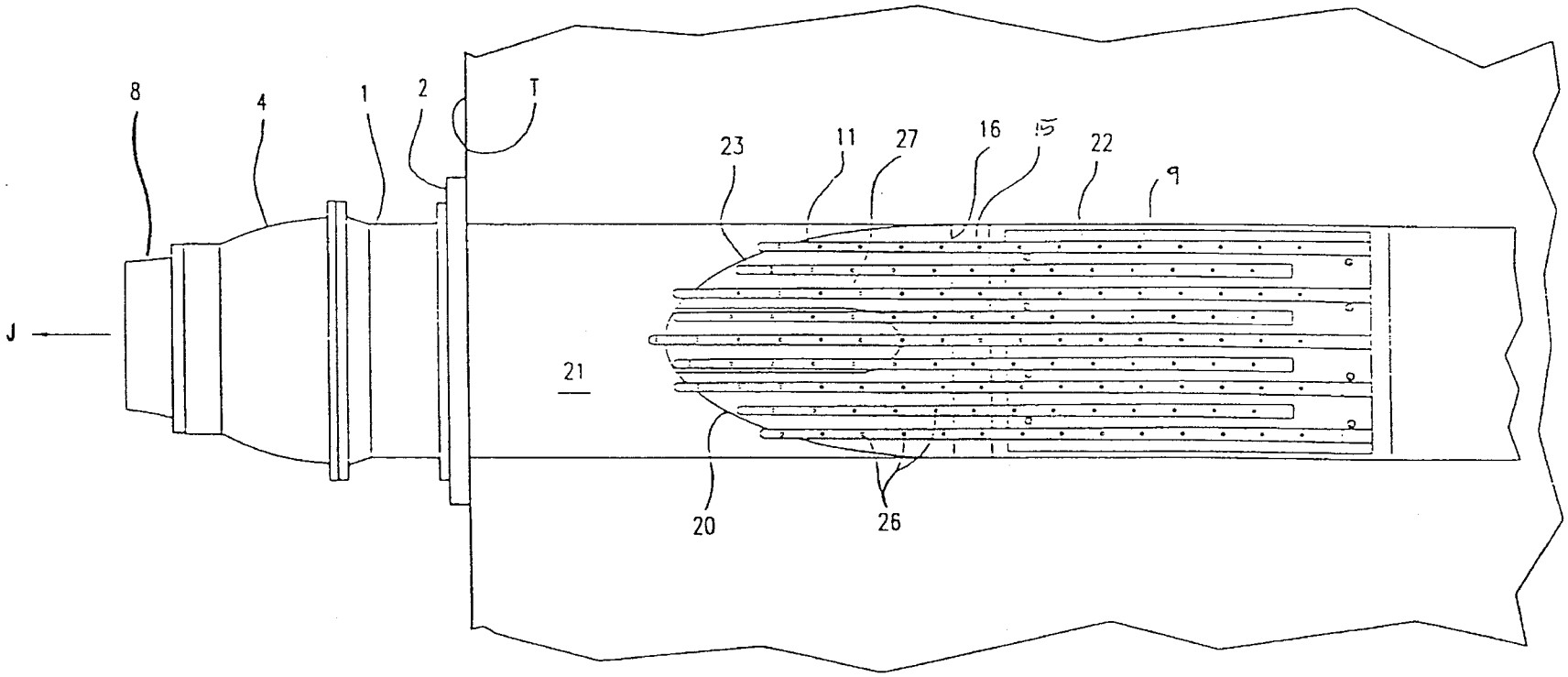
FIG. 2 is a bottom view of the grid bar and intake trailing edge.
Figure 3:
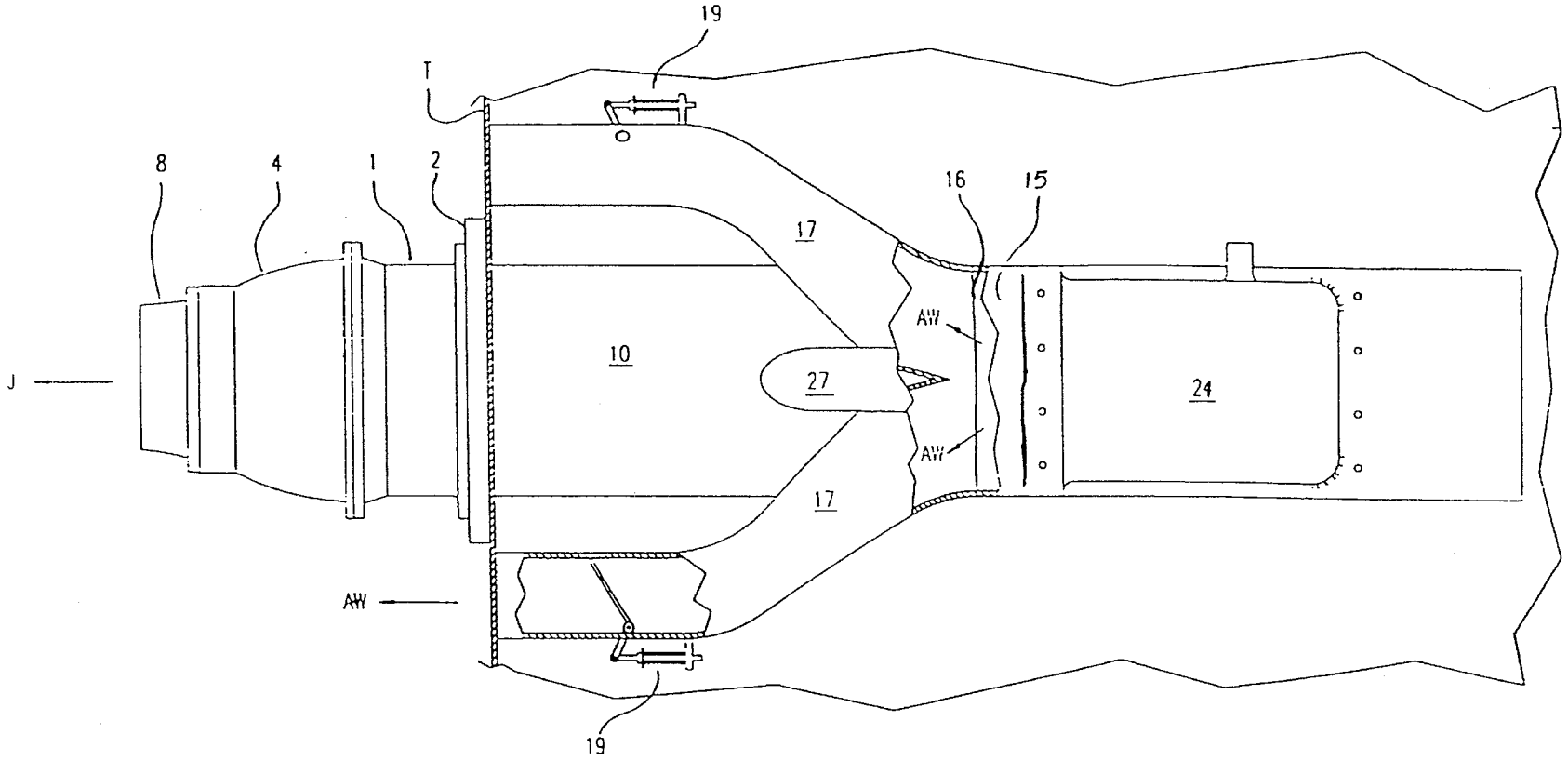
FIG. 3 is a plan view partially in section through the intake duct and aerated water removal duct.
Figure 4:
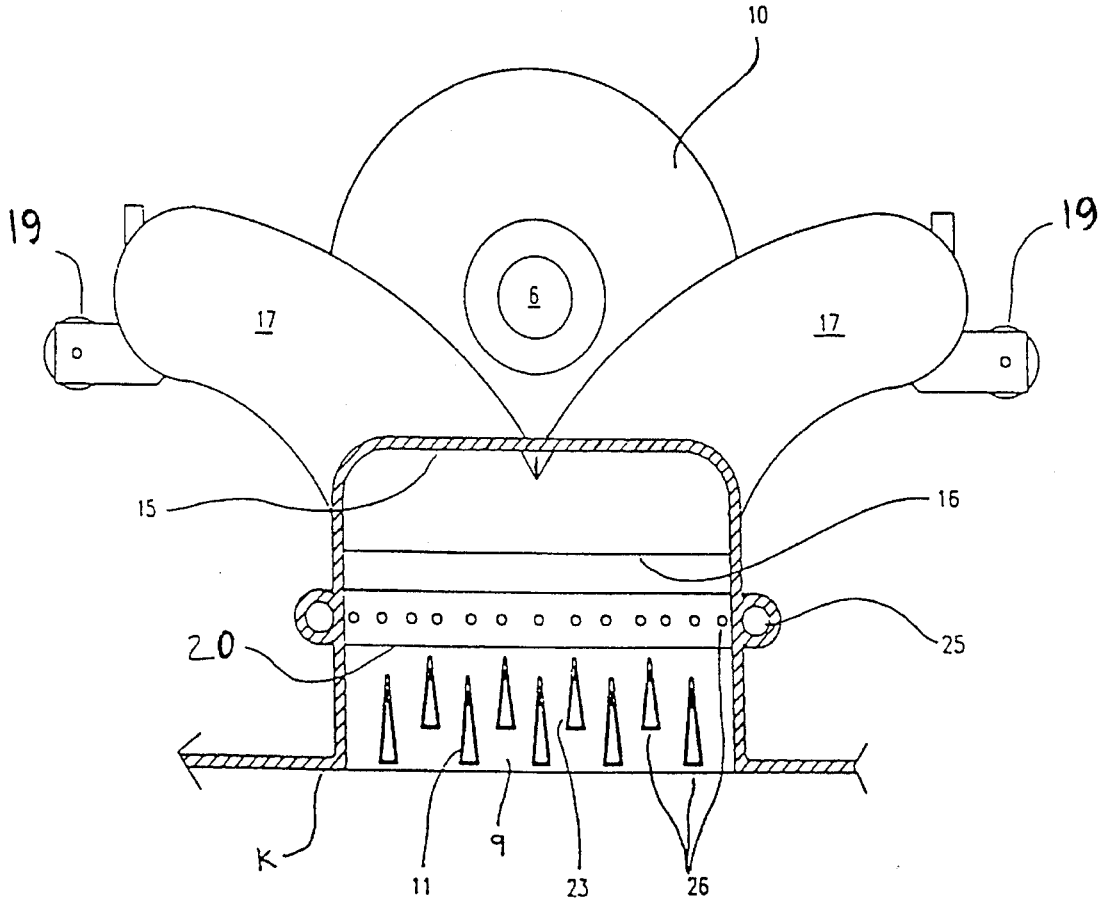
FIG. 4 is a cross-sectional view of the intake duct looking aft and showing the aerated water removal duct, the grid bars and the raised trailing edge of the intake duct.

As shown in FIGS. 1, 2 and 4, the intake duct 10 is a substantially tubular element or member having an intake opening 9 and a second opposed end. In the preferred embodiment hereof, the opposed end is substantially normal to the opening 9 and is attached to the transom T by any suitable means, such as by welding, fastening or the like.

The tubular element, defining the duct 10, has a perimetrial edge which defines the perimeter about the opening 9. The perimetrial edge is configured such that a first or forward portion thereof is substantially flush with the keel surface K. The edge has a second or trailing portion or edge 20 integral with the first portion and which is raised above the keel surface K.

The raised trailing edge 20 produces a decrease in apparent intake opening 9 size as the vessel speed increases, offsetting the increase of flow of water into intake duct 10 as a result of higher vessel velocity. The real intake opening 9 size is not affected, so that at low speed water inflow is not diminished.

A ramp surface 21 extends between the trailing edge 20 and the lowest point of transom T. The surface 21 forms the rear part of the intake duct 10. The surface 21 is slanted downwardly and rearwardly as a result of the raised position of trailing edge 20. The angle of the surface 21 preferably ranges from between about 5 to 15 degrees, relative to keel surface K, but is not so limited. The surface 21 serves to provide added hull lift.

As shown in FIGS. 1, 2, 3 and 4, the intake duct 10 has an upper wall 15. A separator baffle 16 and a flange plate 22 are disposed on the wall 15. The baffle 16 leads or directs aerated water to at least one discharge duct 17, which is connected to the transom T by any suitable means.

When the vessel is at planing speed, the pressure in the intake duct 10 is atmospheric and a aerated water layer AW, resulting from vessel movement through the water, occurs adjacent the keel surface K and the upper wall 15 of the intake duct 10. The separator baffle 16 is advantageously placed so as to divert the aerated water layer AW to the transom T via the duct 17. Thus, the baffle 16 defines means for directing aerated water out of the intake duct 10 and into the discharge duct 17.

Means for regulating flow into the duct 17 is positioned in the duct 17. The means for regulating comprises a check valve 19 or the like disposed in the duct 17.

The check valve 19 is opened by the rearward flow of the aerated water through the duct 17. Aerated water is thus prevented from impairing the efficiency of the impeller 3 at high speed and air is prevented from entering the intake duct 10 at low speed. Alternatively, the means for regulating may be a flapper valve (not shown) located at the end of duct 17 at transom T.

Further, the duct 17 may be connected to the keel surface K near the transom T. Then, the aerated water flow through duct 17 may be regulated by an adjustable port check valve having means to select the aperture of the valve in the direction of passing flow. Alternately, the means for regulating may comprise a pressure control check valve, requiring a certain selectable pressure to be generated upstream of the pressure control check valve before opening in the direction of passing flow. A combination of any of these means may be used to allow aperture and pressure selection to optimize aerated water flow separation.

Referring again to the drawing, and as shown in FIGS. 1, 2 and 4, the marine jet drive may further include means for limiting debris into the duct 10, such as a plurality of grid bars 11, disposed in the water intake duct 10. The bars 11 are disposed in a vertical plane and are parallel or co-axial with the vessel forward movement F. The lower edges of the grid bars 11 are flush with keel surface K, as shown. The grid bars 11 are secured to the flange plate 22 by any suitable means well-known to the skilled artisan.

The grid bars 11 are advantageously rearwardly tapered in order to provide increased clearance therebetween. Thus, as debris in the water flowing into the intake moves aft along or through the bars 11, any opportunity for the debris to wedge and plug the grid is precluded. The grid bars 11 may be staggered in the vertical plane by placing some of the grid bars (denoted at 23) higher up on the flange plate 22 and parallel to the lower grid bars 11, to stop wedging of larger debris between the lower bars. The stub ends of the grid bars 11 or 23 are located below the trailing edge 20 and are not attached thereto, preventing debris from lodging against the trailing edge 20.

The water flow direction along the stub ends of grid bars 11 and 23 is in a downward direction and below the trailing edge 20, effectively removing debris from bars 11 and 23.

At least some of the grid bars 11 or 23 may have hollow interiors. A plenum chamber 24, formed by the grid bar flange plate 22 and a recess in the upper surface 15 of the intake duct 10, is in fluid communication with the hollow interiors. The plenum is used to deliver pressurized or compressed fluid to the hollow interiors. A plurality of apertures 26 are formed in the grid bars 11 and 23, and are used to pass the pressurized or compressed fluid to the grid bar surfaces for clearing debris clinging thereto. A suitable fluid conductor, such as a conduit (not shown), may connect the high water pressure space behind the impeller blades 14, as a pressurized fluid source, to the plenum 24. Alternately, an accumulator (not shown) may discharge fluid under high pressure into the plenum 24 and the grid bar apertures 26 to quickly free any debris that may have lodged in the grid bars.

Similarly, the trailing edge 20 may be provided with a tubular manifold 25 with a plurality of apertures 26, to clear the trailing edge of debris by means of high pressure fluid. The manifold 25 may be in fluid communication with the plenum chamber 24 of the grid bars. Thus, the bars are provided with means for purging debris therefrom.

Figure 5:
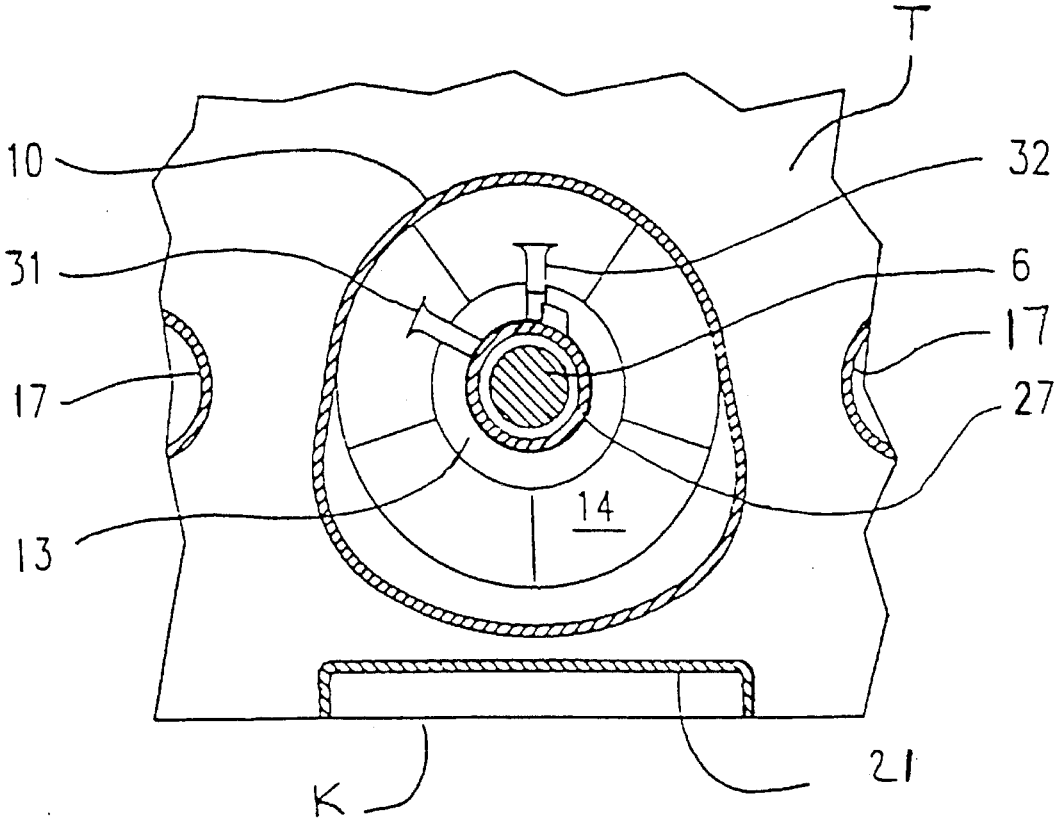
FIG. 5 is a cross-sectional view looking aft, showing the long stranded debris cutting device.

As shown in FIGS. 1 and 5, the marine jet drive may further include a shaft sleeve 27 disposed in the intake duct 10 and which encloses the drive shaft 6. The sleeve 27 is supported by the intake upper wall 15 and by upper and lower longitudinal webs 28 and 29 disposed in the intake duct 10. The sleeve 27, by producing turbulence in the water inflow in duct 10, prevents the exposure of the rotating drive shaft 6 to debris that might be ingested by the intake duct 10 and get wrapped around drive shaft 6, inducing cavitation of the impeller 3.

The shaft sleeve 27 also defines a fixed support for means for cutting debris, such as a debris cutting assembly 30, mounted at the interface of the impeller hub 13 and the shaft sleeve itself. The assembly 30 cuts long stranded debris that has passed through the grid bars 11 to prevent it from wrapping itself around the impeller hub 3 and against impeller blades 14. The cutting assembly 30 comprises at least one and, preferably, a plurality of rotating blades 31 fastened to the impeller hub 3 and one or more stationary blades 32, attached to the shaft sleeve 27. The rotating blade 31 grabs long stranded debris as it rotates and cuts it when passing the stationary blade 32. The cut debris will pass through the pump because it is too short to wrap around the impeller hub 13.

It is to be appreciated from the preceding that there has been described herein an improved intake duct for a jet propulsion system which enables improved efficiency by enabling separation of aerated water and removal of debris therefrom.

Having thus described the invention, what is claimed is:

1. A jet drive for propelling a vessel, comprising:

(a) a vessel engine;

(b) a rotatable impeller coupled to the engine;

(c) an impeller housing, the impeller being disposed therewithin;

(d) a diffuser housing attached to the impeller housing;

(e) a nozzle housing attached to the impeller housing;

(f) a transom for supporting the impeller housing;

(g) a fluid intake duct disposed in the drive forward of the impeller housing and having an intake opening and second opening, the second opening being connected to the transom, the intake opening being defined by a perimetrial edge of the duct, the edge having a first portion substantially flush with the bottom of the vessel and a second portion defining a trailing edge, the trailing edge being raised above the forward portion and a ramped surface part connecting the trailing edge and the lowest point of the transom, the ramp surface sloping downward fore to aft.

2. The jet drive of claim 1 which further comprises:

a separator baffle disposed in the intake duct and connected to the wall thereof, the baffle being spaced apart from the wall and defining a space therebetween, at least one discharge duct having a first end and a second end and being in fluid communication with the space at one end thereof, and to transom of the vessel at the second end.

3. The jet drive of claim 2 further comprising:

means for regulating flow in the discharge duct to control fluid flow direction, volume and pressure, the means being disposed in the duct.

4. The jet drive of claim 3 wherein the means for regulating comprises a check valve.

5. The jet drive of claim 1, further comprising:

(a) a plurality of grid bars, each bar having a forward grid bar end and a rearward grid bar end;

(b) a support flange disposed in the duct proximate the first portion of the perimetrial edge, the grid bars being attached to the flange, and wherein the rearward grid bar end of each grid bar is a stub end.

6. The marine jet drive of claim 5, wherein the grid bars are disposed in a vertically staggered array on the support flange.

7. The marine jet drive of claim 5 which further comprises:

means for purging debris from the grid bars and the trailing edge.

8. The marine jet drive of claim 7 wherein:

at least some of the grid bars have a hollow interior, each of the at least some of the grid bars have at least one aperture formed therein in communication with the hollow interior thereof, the drive further comprising a source of pressurized fluid in fluid communication with the hollow interior of each of the at least some of the grid bars.

9. The jet drive of claim 8 wherein the trailing edge further comprises:

a tubular manifold having at least one aperture formed therein, the manifold being in fluid communication with the source of pressurized fluid.

10. The jet drive of claim 1 which further comprises:

means for cutting debris disposed in the intake duct.

11. The jet drive of claim 10 which further comprises:

(a) a tube disposed around the drive shaft;

(b) a rotating cutting blade radially attached to the impeller hub;

(c) a stationary cutting blade attached to the tube proximate the impeller hub, and wherein rotation of the hub produces a shearing action between the stationary cutting blade and the rotary cutting blade, the rotating blade and the stationary blade defining the means for cutting debris.

12. An intake duct for a fluid delivery system, comprising:

(a) a substantially tubular wall having first and second open ends and a perimetrial about each end, one end defining an intake end, the perimetrial edge of the wall about the intake end having a first portion in a first plane and a second portion, integral with the first portion and axially displaced therefrom, the second portion being parallel to the first portion and defining a trailing edge for the intake end, and a ramped surface extending downwardly from the trailing edge and ending in the plane of the first portion.

13. The duct of claim 12 which further comprises:

(a) a baffle disposed interiorly of the duct proximate the first portion of the perimetrial edge and depending from the tubular wall, the baffle and the wall cooperating to define a space therebetween.

14. The duct of claim 13 which further comprises:

(a) a support plate secured to the interior of the duct proximate the intake duct;

(b) at least one grid bar secured to the support plate, the grid bar being tapered, the grid bar defining means for preventing debris from entering the intake opening duct.

15. A jet drive for propelling a vessel, comprising:

(a) a vessel engine;

(b) a rotatable impeller coupled to the engine;

(c) an impeller housing, the impeller being disposed therewithin;

(d) a diffuser housing attached to the impeller housing;

(e) a nozzle housing attached to the impeller housing;

(f) a transom for supporting the impeller housing;

(g) a fluid intake duct disposed in the drive forward of the impeller housing and having an intake opening and second opening, the second opening being defined by a perimetrial edge of the duct, a separator baffle disposed in the intake duct and connected thereto, the baffle being spaced apart from the duct wall and defining a space therebetween, at least one discharge duct having a first end and a second end and being in fluid communication with the space at one end thereof and to the transom at the second end, and means for regulating the flow in the discharge duct.

* * * * *